United States Patent [19]

Caraher et al.

[11] Patent Number: 4,866,748

[45] Date of Patent: Sep. 12, 1989

[54] ROTOR STRUCTURE BRAZED JOINT

[75] Inventors: James R. Caraher, Stamford; Albert F. Fengler, Wilton; Ming-Wei P. Xu, Stamford, all of Conn.

[73] Assignee: Varian Associates, Inc., Palo Alto, Calif.

[21] Appl. No.: 232,250

[22] Filed: Aug. 15, 1988

[51] Int. Cl.[4] ..... H01J 35/00

[52] U.S. Cl. ..... 378/121; 378/143; 378/144

[58] Field of Search ..... 378/121, 143, 144

[56] References Cited

U.S. PATENT DOCUMENTS

| | | | |
|---|---|---|---|
| 3,699,373 | 10/1972 | Holland et al. | 313/60 |
| 3,753,021 | 8/1973 | Brann | 378/144 |
| 3,855,492 | 12/1974 | Langer et al. | 313/60 |
| 4,130,773 | 12/1978 | Küssel | 378/144 |
| 4,225,787 | 9/1980 | Shapiro et al. | 250/406 |
| 4,545,064 | 10/1985 | Klostermann | 378/121 |
| 4,574,388 | 3/1986 | Port et al. | 378/144 |
| 4,736,400 | 4/1988 | Koller et al. | 378/125 |

FOREIGN PATENT DOCUMENTS

| | | | |
|---|---|---|---|
| 0055828 | 7/1982 | European Pat. Off. | 378/144 |
| 58-126201 | 7/1983 | Japan . | |

*Primary Examiner*—Craig E. Church
*Assistant Examiner*—John C. Freeman
*Attorney, Agent, or Firm*—Stanley Z. Cole; John C. Yakes; David Schnapf

[57] ABSTRACT

An x-ray rotor structure wherein a target support stem has an externally threaded end portion brazed to an internally threaded surface of an encircling bushing which is provided with a barrier layer of oxidation restricting material. The stem is made of predominantly molybdenum material and the bushing is made of iron cobalt nickel alloy material having therein a small percentage by weight of titanium. The barrier layer comprises a layer of substantially pure nickel material which coats the entire inner surface of the bushing including the internally threaded portion thereof. Thus, the titanium is restricted from leaching to the surface during brazing and forming oxides which prevent the surface from being completely wetted by the brazing material. As a result, during brazing, the liquified brazing material alloys with the nickel material of the barrier layer to wet the inner surface of the bushing completely. Consequently, upon cooling, the alloyed brazing material and the nickel material of the barrier layer constitute an interlocking layer forming a durable brazed joint for fixedly attaching the bushing to the stem.

11 Claims, 2 Drawing Sheets

ROTOR STRUCTURE BRAZED JOINT

BACKGROUND OF THE DISCLOSURE

1. Field of the Invention

This invention relates generally to x-ray tubes of the rotating anode type and is concerned more particularly with an x-ray tube having a rotor structure with improved means for supporting a rotatable target disc.

2. Discussion of the Prior Art

A conventional x-ray tube of the rotating anode type includes a tubular envelope having transversely disposed therein an anode target disc with an outer annular portion called the focal track. The focal track is made of x-ray emissive material and has a radially sloped surface with a focal spot area disposed in spaced alignment with an electron emitting cathode. Electrons beamed from the cathode onto the aligned focal spot area penetrate into the underlying material of the focal track and generate x-rays which radiate from the focal spot area. Since most of the electron energy impinging on the focal spot area is converted into heat, the target disc is rotated thereby constantly changing the portion of the focal track in the focal spot area and allowing the heat to dissipate by radiation through the envelope of the x-ray tube.

Therefore, the target disc is supported for axial rotation by a bearing mounted rotor structure including an axially extending stem having one end portion attached to a central portion of the target disc. The stem usually is provided with a minimum cross-sectional size for rotatably supporting the target disc while restricting the flow of heat therefrom by conduction to the rotor structure. An opposing end portion of the stem is attached, generally by brazing, to a closed end of a tubular rotor skirt which is rotatably supported on a rotor shaft mounted in bearings.

However, it has been found difficult to produce between the closed end of the rotor skirt and the adjacent end portion of the stem a brazed joint which is sufficiently strong and durable for withstanding the stresses developed during rotation of the target disc. It may be found that, after an unexpectedly short time, the brazed joint will weaken and crack whereby the rotating target disc will commence to wobble and may damage the tube envelope. Also, the wobbling rotation of the target disc will adversely affect the bearings supporting the rotor shaft and may eventually cause permanent damage to the bearings.

SUMMARY OF THE INVENTION

Accordingly, these and other disadvantages of the prior art are overcome by this invention providing an x-ray tube rotor structure with a target stem component fixedly attached to a coaxial armature component through interposed first and second coaxial members. The first member has an inner annular surface fixedly attached by a brazed joint to the stem component, and has an outer cylindrical surface fixedly attached by a welded joint to the second member which has an outer marginal portion fixedly attached to the armature component. Also, the first member is made of a material having a linear thermal expansion coefficient closely matched to the linear thermal expansion coefficient of the stem component material. Moreover, the second member is made of a material having a linear thermal expansion coefficient more closely related to the linear thermal expansion coefficient of the armature component material than to the linear thermal expansion coefficient of the stem component material. As a result, the greatest thermal disparity and the maximum thermal stresses occur between the first and second members at the welded joint which is stronger and better enabled to withstand these maximum thermal stresses than the brazed joint between the first member and the stem component.

A strong and durable brazed joint is achieved between the first member and the stem component, which may be threadingly engaged with one another, by plating a layer of barrier material on the threaded surface of the first member prior to engagement with the stem component. After the stem component is disposed in threaded engagement with plated surface of the first member, brazing material is applied between the respective threaded surfaces of the stem component and the first member. As a result, the braze material alloys with the barrier material plated on the threaded surface of the first member and "wets" both of the threaded surfaces. When the brazing operation is completed, the stem component is fixedly attached to the inner annular surface of the first member by a brazed joint comprising an interlocking layer of the brazing material alloyed with the barrier material.

BRIEF DESCRIPTION OF THE DRAWINGS

For a better understanding of the invention, reference is made in the following detailed description to the drawings wherein.

DESCRIPTION OF THE PREFERRED EMBODIMENT

Figures 1, 1A:
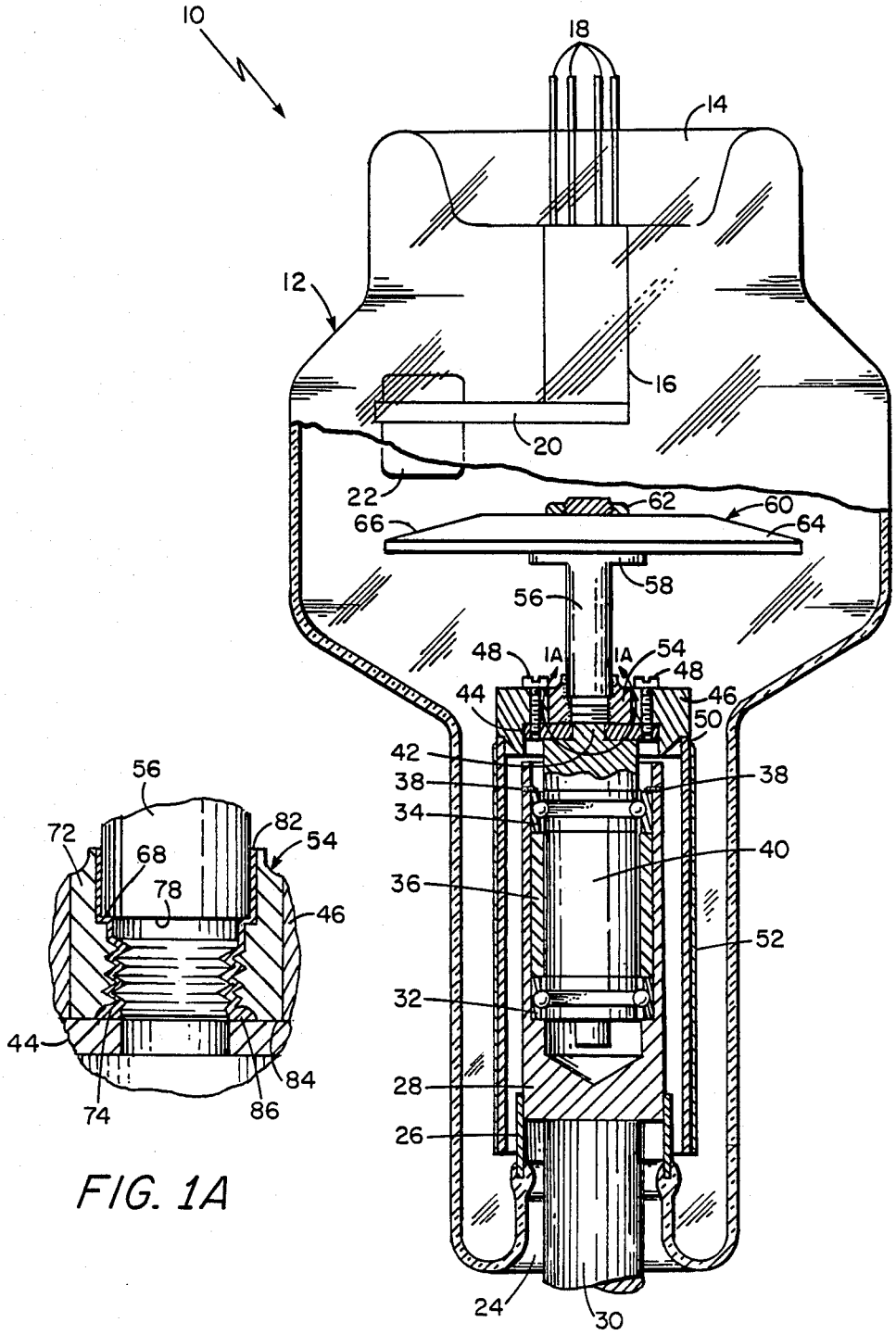
FIG. 1 is an elevational view, partly in axial section, of an x-ray tube embodying the invention.
FIG. 1A is an enlarged axial sectional view of the portion of the rotor structure encircled by the line 1A-1A shown in FIG. 1.

Referring to the drawings wherein like characters of reference designate like parts, there is shown in FIG. 1 an x-ray tube 10 of the rotating anode type having a tubular envelope 12 made of dielectric material, such as lead-free glass, for example. The envelope 12 has a reentrant end portion 14 peripherally sealed to a cylindrical end portion of a cathode support member 16 having a well-known structure through which a plurality of cathode conductors 18 pass hermetically into the envelope 12. Cathode support member 16 extends axially within envelope 12 and has an inner end attached to a proximal end portion of a hollow cantilever arm 20 of well-known design through which the cathode conductors 18 are directed. The cantilever arm 20 has a distal end portion supporting an electron emitting cathode 22 of a well-known type to which the cathode conductors 18 are connected electrically. Thus, the cathode conductors 18 provide means for supplying filament current to the electron emitting cathode 22 and for maintaining it at cathode potential with respect to electrical ground.

The envelope 12 has an opposing reentrant end portion 24 which is peripherally sealed to one end portion of an axially disposed collar 26 made of kovar material.

Collar 26 has an opposing end portion circumferentially attached to a solid end portion of a cup-like casing 28 made of rigid material which is highly conductive to magnetic flux, such as cold rolled steel, for example. The solid end portion of cup-like casing 28 is integrally joined to an adjacent end of an anode terminal post 30 which extends axially out of the reentrant portion 24 and exteriorly of the envelope 12. Thus, the terminal post 30 provides means for cooling the anode structure of tube 10 and for electrically maintaining it at anode potential with respect to electrical ground.

The casing 28 extends axially within envelope 12 and has an opposing open end which provides access to the interior of casing 18 during assembly. Within the cup-like casing 28 and adjacent the closed end portion thereof, a first ball bearing member 32 is disposed in axially aligned, contiguous relationship with an annular shoulder portion of the casing 28. Ball bearing member 32 is axially spaced from an aligned second ball bearing member 34 by an interposed tubular spacer 36 made of rigid material which is highly permeable to magnetic flux, such as cold rolled steel, for example. The ball bearing members 32 and 34, respectively, and the interposed tubular spacer 36 are held in axially stacked relationship against the annular shoulder portion of casing 28 by a plurality of set screws 38. Set screws 38 are journalled through respective threaded holes, which extend radially through the axial wall of cup-like casing 28, and emerge in the interior therof adjacent the exposed end of second ball bearing member 34.

The respective ball bearing members 32 and 34 support for axial rotation an encircled rotor shaft 40 made of rigid nonmagnetic material, such as tool hardened steel, for example. Rotor shaft 40 extends axially out of the open end of casing 28 and terminates adjacent thereto in an annular shoulder defining a reduced diameter end portion 42 of shaft 40. Fixedly attached, as by welding, for example, to the reduced diameter end portion 42 of shaft 40 is an encircling washer-like nailhead 44. Nailhead 44 is fixedly attached to an axially aligned, annular plug 46 by a plurality of screws 48 which extend axially through respective holes 47 (FIG. 2) in the plug 46. The screws 48 are threaded into respective aligned holes in the nailhead 44 until the nailhead 48 is drawn tight against the adjacent surface of plug 46. Plug 46 has an outer marginal portion to which is circumferentially attached, as by welding, for example, an adjacent end portion of tubular rotor skirt 50. The skirt 50 is disposed in radially spaced, coaxial relationship with the casing 28, and is made of rigid material which is highly conductive to magnetic flux, such as cold rolled steel, for example. Thus, the cold rolled steel material of rotor skirt 50 is fixedly attached to the tool hardened steel material of rotor shaft 40 through annular plug 46, screws 48 and nailhead 44.

Accordingly, the nailhead 44, screws 48 and annular plug 46 are thermally matched to one another by virtue of being made of the same iron-chrome-nickel alloy material, such as Hastelloy "X" material made by Haynes International of Kokomo, Ind., for example, which has a linear thermal expansion coefficient of about $84\times10^{-7}$ per degree Fahrenheit. Also, the Hastelloy "X" material is thermally compatible with the cold rolled steel material of skirt 50 which has a linear thermal expansion coefficient of $75\times10^{-7}$ per degree Fahrenheit. The rotor skirt 50 has attached, as by diffusion bonding, for example, to its outer surface a tubular sheath 52 of electrically conductive material, such as copper, for example, which has a linear thermal expansion coefficient of about $95\times10^{-7}$ per degree Fahrenheit. The sheath 52 of copper is maintained sufficiently thin with respect to the cold rolled steel material of skirt 50 that it does not have an adverse thermal effect on the supporting rotor skirt 50.

Sheath 52 and rotor skirt 50 constitute the rotatable armature component of an alternating current induction motor having a stator component (not shown) disposed externally of envelope 12 and in spaced encircling relationship with the rotor skirt 50. As a result, the skirt 50 is rotated by virtue of currents induced electromagnetically in the copper sheath 52 and acts through the annular plug 46, screws 48 and nailhead 44 to rotate the shaft 40 in the ball bearing members 32 and 34, respectively. Thus, it may be seen that having the rotor skirt 50 and the casing 28 made of material highly conductive to magnetic flux, such as cold rolled steel, for example, is advantageous for enhancing the magnetic fields of the induction motor and enabling the armature component thereof to maintain a predetermined speed even when rotating a relatively large and heavy target disc.

The inner surface of annular plug 46 is a peripherally attached, as by electron beam welding, for example, to an outer cylindrical surface of a bushing 54 having an inner annular surface provided with internal threads, as shown more clearly in FIG. 1A. Bushing 54 is made of iron cobalt nickel alloy material, such as Incoloy 909 sold by Inco Alloys International, Inc. of Huntington, W. Va., for example, which includes a small percentage of titanium, such as less than two percent by weight of the material, for example. The Incoloy 909 material of bushing 52, which has a linear thermal expansion coefficient of $60\times10^{-7}$ per degree Fahrenheit, is thermally compatible with the Hastelloy "X" material of annular plug 46. However, it is worth noting that the linear thermal expansion coefficient of the Incoloy 909 material differs by about twenty-four units from the linear thermal expansion coefficient of the Hastelloy "X" material of plug 46 which, as stated previously, has a linear thermal expansion coefficient of $84\times10^{-7}$ per degree Fahrenheit.

Journalled into the bushing 52 is a threaded end portion of a rotatable nosepiece or stem 56 which is fixedly secured therein, as by brazing, for example. In order to restrict the flow of heat by conduction into the described rotor structure, the nosepiece or stem generally is provided with a minimum cross-sectional size for rotatably supporting a target disc and generally is made of a relatively poor heat conductive material, such as molybdenum, for example. In more recently developed rotor structures, the nosepiece or stem, such as 56, for example is made of a molybdenum alloy material generally referred to as TZM which comprises about ninety-nine percent molybdenum with fractional percentages of titanium and zirconium. The TZM material exhibits greater structional strength than the molybdenum material and is easier to machine, such as when providing external threads on the end portion of stem 56 journalled into bushing 54, for example. Moreover, the TZM material has a linear thermal expansion coefficient substantially equal to the linear thermal expansion coefficient of molybdenum which is about $58\times10^{7}$ per degree Fahrenheit. Consequently, the molybdenum or TZM material of stem 56 is thermally compatible with the Incolloy material of bushing 54 which, as stated previously, is about $60\times10^{7}$ per degree Fahrenheit.

The opposing end portion of stem 56 is provided with an annular flange 58 which supports a transversely disposed, target disc 60 having a frusto-conical configuration. Target disc 60 has a central portion through which a threaded end portion of stem 56 extends and is engaged by a hex nut 62 for fixedly securing the target disc 60 to the stem 56. The target disc 60 has an outer marginal portion comprising an annular focal track 64 made of x-ray emissive material, such as tungsten or an alloy of tungsten, for example. Focal track 64 has a radially sloped surface with a focal spot area 66 disposed in spaced axial alignment with the electron emitting cathode 22.

Accordingly, in operation, the cathode 22 and the anode target disc 60 are maintained at suitable electrical potentials for electrostatically beaming electrons from the cathode 22 onto the focal spot area 66 of focal track 64. The beamed electrons impinge on the focal spot area 66 with sufficient kinetic energy to penetrate into the underlying x-ray emissive material of focal track 64 and generate x-rays which radiate from the focal spot area 66. However, most of the electron energy is converted into heat which may damage the x-ray emissive material of focal track 64 in the focal spot area 66. Consequently, the target disc 60 is rotated at suitable speeds, which may be as high as ten thousand revolutions per minute, for example, for continously changing the portion of focal track 64 in the focal spot area 66. As a result, the heat energy from portions of focal track 64 rotated out of the focal spot area 66 is stored in the material of x-ray target disc 60 and preferably is dissipated by radiation through the envelope 12 of tube 10.

Despite the precautions taken with the stem 56 for protecting the rotor structure and particularly the respective bearing members 32 and 34 from damage due to excessive heat, some of the heat energy stored in target disc 60 is dissipated by conduction through the stem 56 and into the rotor structure. The resulting thermal stresses in the rotor structure generally occur in the brazed joint between the stem 56 and the member of the rotor structure because of the differences in their respective linear thermal expansion coefficients. However, as may be seen in the table below:

| Rotor Part | Material | Expansion Coefficient (per °F.) |
|---|---|---|
| Nosepiece or stem 56 | TZM | $58 \times 10^{-7}$ |
| Bushing 54 | Incolloy 909 | $60 \times 10^{-7}$ |
| Plug 46 Nailhead 44 and Screws 48 | Hastelloy "X" | $84 \times 10^{-7}$ |
| Skirt 50 | Cold Rolled Steel | $75 \times 10^{-7}$ |

the maximum thermal stresses occur at the welded joint between bushing 54 and plug 46 rather than at the brazed joint between stem 56 and bushing 54. Thus, the described rotor structure has greater durability than rotor structures of the prior art because the maximum thermal stresses occur at a welded joint which is stronger structurally than a brazed joint. Furthermore, the Hastelloy "X" material of plug 46 and the Incoloy 909 material of bushing 54 have greater structural strength than the TZM material of stem 56 and, consequently, are better able to withstand the maximum thermal stresses.

In order to achieve a more durable brazed joint between the bushing 54 and the stem 56, the internally threaded surface of bushing 54 and the externally threaded surface of stem 56 are with provided respective diametric sizes for obtaining an interposed gap when the stem 56 is fully installed in the bushing 54, as shown more clearly in FIG. 1A, for example. This gap has a width dimension in the range of two thousandths to eight thousandths of an inch and provides the necessary capillary action for ensuring that the brazing material will flow between the threaded surfaces from one end to the opposing end of bushing 54 to form the brazed joint. Consequently, during operation of tube 10, any thermal stresses developed between the bushing 54 and the stem 56, such as due to slight differences in thermal expansion, for example, are relieved by being distributed over the entire gap filled with brazing material. Accordingly, the gap is sufficiently narrow that the brazed joint is enabled to hold the respective threaded surfaces of bushing 54 and stem 56 firmly in interlocking relationship. Yet, the gap is sufficiently wide that the brazed joint is enabled to relieve thermal stresses and thereby prevent overstressing of the braze joint which may subsequently cause cracking of the brazed joint.

Also, it has been found that if the brazing material has a melting temperature above 1150° C., the molybdenum component of the TZM material forming stem 56 has a tendency to unite with a metal component of the brazing material to form intermetallic compound material which is very brittle and may cause cracking of the brazed joint. On the other hand, if the brazing material has a melting temperature below 900° C., the resulting brazed joint may soften during operation of the tube and fail to withstand the mechanical stresses exerted on the brazed joint when rotating the target disc 60 at relatively high speeds. Consequently, the braze material selected to fill the gap between the respective threaded surfaces of bushing 54 and stem 56 comprises a nickel alloy material having a melting temperature in the range of 1000° C. to 1100° C. For example, a braze material comprising an alloy of nickel, gold and palladium having a liquidus temperature of about 1037° C. and a solidus temperature of about 1005° C. was found to be particularly well suited for forming the brazed joint between the respective threaded surfaces of bushing 54 and stem 56. The nickel component of the braze material provides a structurally strong joint; and the associated melting temperature of 1037° C. is well within the specified range of melting temperatures for minimizing the possibility of nickel-molybdenum intermetallic compounds forming during the brazing operation or during subsequent thermal cyling when operating the tube 10.

Moreover, it has been found that, during the brazing operation, the liquified brazing material would not fully "wet" the exposed inner surface of bushing 54 having the internally threaded portion. As a result, the internally threaded surface of bushing 54 would be bonded to the externally threaded surface of stem 56 by an incompletely brazed joint which would weaken and crack during operation of the tube. An investigation disclosed that, during the heating phase of the brazing operation, the titanium component of the Incoloy 909 material constituting the inner annular surface of bushing 54 was uniting with oxygen to form titanium oxide material. Furthermore, it was this titanium oxide material which was preventing the liquified brazing material from fully "wetting" the inner annular surface of bushing 54.

Figure 2:
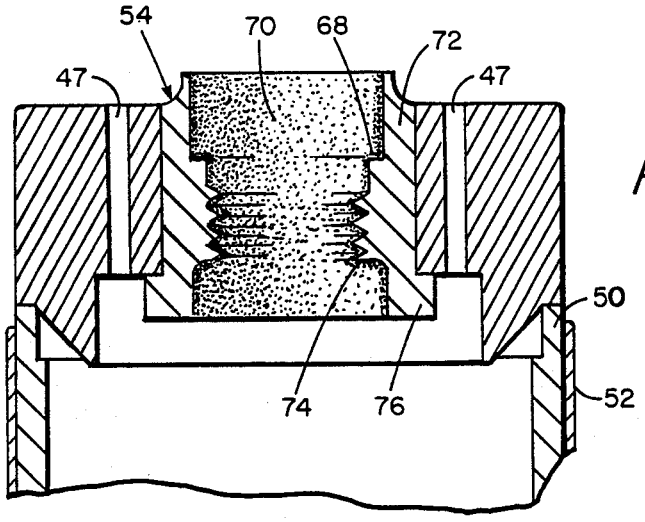
FIG. 2 is an axial section view of the bushing shown in FIG. 1A after plating.

As shown in FIG. 2, this problem has been solved by providing the inner annular surface of bushing 54, prior to the brazing operation, with a barrier layer 70 of substantially pure nickel material which extends from one end to the opposing end of bushing 54. Barrier layer 70 has a thickness in the range of 0.0007 to 0.0009 of an inch which does not affect the thermal characteristics of bushing 54. The threaded portion of bushing 54 terminates adjacent one end thereof in annular shoulder 68 which integrally joins the threaded portion to a larger diameter end portion 72 of the bushing. Also, the threaded portion of bushing 54 terminates adjacent the other end thereof in an annular shoulder 74 which integrally joins the threaded portion to a larger diameter extension 76 of the bushing. The barrier layer 70 of substantially pure nickel material may be applied to the entire inner annular surface of bushing 54 by conventional means, such as plating, for example.

Figure 3:
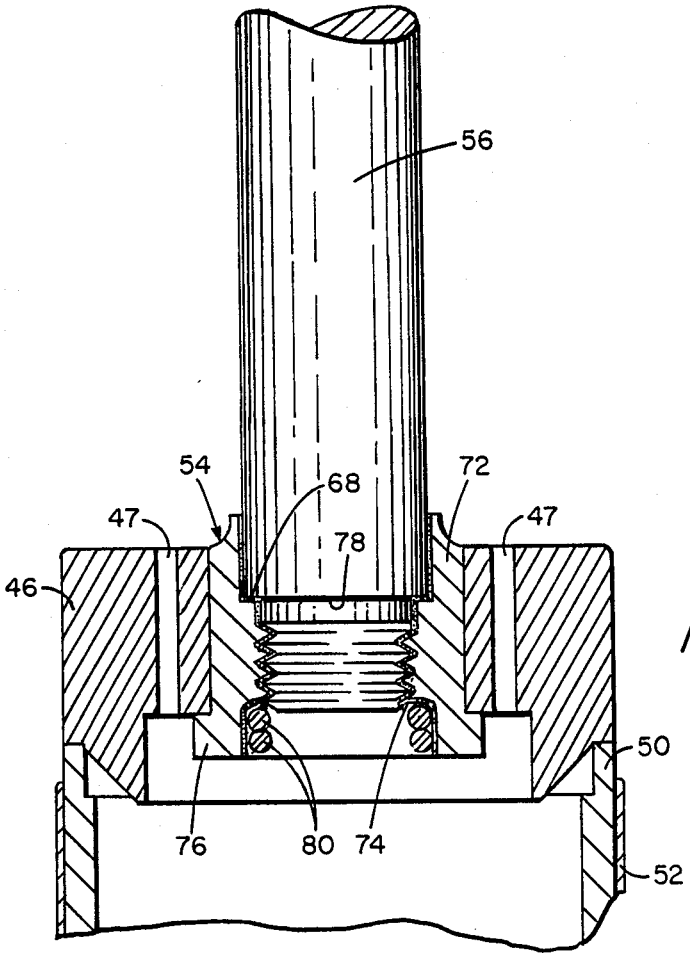
FIG. 3 is an axial sectional view of the plated bushing shown in FIG. 2 but having the rotor stem shown in FIG. 1 journalled therein and prepared for brazing.

As shown in FIG. 3, after the plating operation, the externally threaded end portion of stem 56, which terminates in an outwardly extending annular shoulder 78 thereof, is inserted into the layer diameter end portion 72 of bushing 54. The externally threaded end portion of stem 56 engages the internally threaded portion of bushing 54 and is journalled therein until the annular shoulder 78 of stem 56 overlies the annular shoulder 68 of bushing 54. The resulting sub-assembly is then inverted and rings 80 of brazing material, such as nickel gold palladium alloy material for example, are inserted into the larger diameter extension 76 of bushing 54 and supported on the annular shoulder 74. Subsequently, during the brazing operation, the rings 80 of brazing material are heated to a liquifying temperature in the range of 1000° C. to 1100° C., such as 1037° C., for example. As a result, the liquified brazing material flows by capillary action and with the aid of gravity through the gap having a width in the range of two thousandths to eight thousandths of an inch and provided between the respective threads of bushing 54 and stem 56. Consequently, the liquified brazing material fills the gap from one end to the opposing end of bushing 54 and alloys with the substantially pure nickel material of layer 70 on the inner annular surface of bushing 54. Thus, the resulting alloy of brazing material and barrier layer material "wets" the adjacent surfaces of bushing 54 and stem 56 to form, upon cooling, a strong and durable brazed joint.

As shown in FIG. 1A, after brazing, there is disposed between the externally threaded end portion of stem 56 and the inner annular surface of bushing 54 an interlocking layer 82 comprising an alloy of the brazing material and the material of barrier layer 70. This interlocking layer 82 extends between the annular shoulders 68 and 78 of bushing 54 and stem 56, respectively, and terminates at the adjacent end of bushing 54. The extension 76 portion of bushing 54 is machined off to provide a substantially flat end surface 84 thereof which is substantially flush with the under-surface of annular plug 46 and the terminal end surface of stem 56. Consequently, the interlocking layer 82 may terminate adjacent the end surface 84 of bushing 54 in a fillet 86 which adheres to the annular shoulder 74 of bushing 54 and the adjacent terminal end portion of stem 56. Thus, the interlocking layer 82 bonds the entire inner annular surface of bushing 54 to the encircled end portion of stem 56. The substantially pure nickel material of barrier layer 70 alloyed with nickel alloy material of brazing rings 80 provides the resulting interlocking layer 82 with a structural strength for withstanding thermal and mechanical stresses developed at the brazed joint during operation of tube 10. Furthermore, the interlocking layer 82 provides the brazed joint with a durability sufficient for rotating the target disc 60 at relatively high speeds, such as ten thousand revolutions per minute, for example, over a relatively long tube life, such as thirty-five thousand exposures, for example.

Thus, there has been disclosed herein an x-ray tube rotor structure comprising an armature component including rotor skirt 50 which is rotatably attached through annular plug 46 and bushing 54 to target stem component 56. The bushing 54 has an inner annular surface fixedly attached by a brazed joint to the stem component 56 and has an outer cylindrical surface fixedly attached by a welded joint to the annular plug 46 which has an outer marginal portion fixedly attached to the rotor skirt 50. Also, the bushing 54 is made of a material having thermal expansion properties closely matched to the material of stem component 56, whereas the plug 46 is made of a material having thermal expansion properties more closely related to the material of rotor skirt 50 than to the material of bushing 54. As a result, the maximum thermal stresses occur at the relatively stronger welded joint between the plug 56 and the bushing 54 rather than at the brazed joint between the bushing 54 and the stem component 56. Moreover, the rotor structure disclosed herein includes a brazed joint comprising the bushing 54 having an inner annular surface provided with a barrier layer 70 of anti-oxidation material which alloys with the brazing material to form an interlocking layer bonding the bushing 54 to the stem component 56.

From the foregoing, it will be apparent that all of the objectives have been achieved by the structures and methods described herein. It also will be apparent, however, that various changes may be made by those skilled in the art without departing from the spirit of the inventive subject matter, as expressed in the appended claims. It is to be understood, therefore, that all matter shown and described is to be interpreted as illustrative and not in a limiting sense.

What is claimed is:

1. An x-ray tube rotor structure comprising:

cylindrical stem means having an end portion for supporting a rotatable x-ray target and having an opposing end portion; and rotatable drive means for rotating said cylindrical stem means and including an annular member having an inner surface disposed in encircling relationship with said opposing end portion and fixedly attached thereto, said inner surface being provided with barrier layer means for protecting said inner surface from oxidation.

2. An x-ray tube rotor structure as set forth in claim 1 wherein said annular member comprises a bushing made of an iron cobalt nickel alloy material including less than two percent by weight of titanium.

3. An x-ray tube rotor structure as set forth in claim 1 wherein said barrier layer means comprises a plated layer of substantially pure nickel having a thickness between 0.0007 and 0.0009 of an inch.

4. An x-ray tube rotor structure as set forth in claim 2 wherein said cylindrical stem means comprises a cylindrical stem made of predominantly molybdenum material.

5. An x-ray tube rotor structure as set forth in claim 4 wherein said bushing has said inner surface provided with internal threads and said cylindrical stem has said opposing end portion provided with external threads which engage said internal threads of said inner surface of the bushing.

6. An x-ray tube rotor structure as set forth in claim 5 wherein said inner surface of said bushing is fixedly attached to said opposing end portion of said cylindrical stem by a brazed joint.

7. An x-ray tube rotor structure comprising:

a cylindrical stem having end portion means for supporting a rotatable x-ray target and having an opposing end portion;

an annular member having an inner surface disposed in encircling relationship with said opposing end portion; and brazed joint means disposed between said annular member and said opposing end portion of said cylindrical stem for fixedly attaching said annular member to said cylindrical stem, said brazed joint means including barrier layer means disposed on said inner surface of said annular member for preventing oxidation of said inner surface.

8. An x-ray tube rotor structure as set forth in claim 7 wherein said cylindrical stem is made of predominantly molybdenum material; and said annular member comprises a bushing made of iron cobalt nickel alloy material.

9. An x-ray tube rotor structure as set forth in claim 8 wherein said barrier layer means comprises a layer of substantially pure nickel material.

10. An x-ray tube rotor structure as set forth in claim 9 wherein said brazed joint means includes brazing material means for alloying with said nickel material of said barrier layer means and forming an interlocking layer attached to said bushing and said opposing end portion of said cylindrical stem.

11. An x-ray tube rotor structure as set forth in claim 10 wherein said inner surface of said bushing and said opposing end portion of said cylindrical stem are provided with respective threaded portions which are engaged with one another.

* * * * *